United States Patent [19]

Terris

[11] 4,176,484

[45] Dec. 4, 1979

[54] DIRECTIONAL SIGN

[76] Inventor: James M. Terris, 2126 Dillon Dr., Fayetteville, N.C. 28306

[21] Appl. No.: 927,644

[22] Filed: Jul. 24, 1978

[51] Int. Cl.[2] ..... G09F 7/00

[52] U.S. Cl. ..... 40/584; 40/124.1; 40/612

[58] Field of Search ..... 40/584, 446, 486, 492, 40/497, 539, 588, 598, 610, 124.1, 591; 116/47, 209, 319, 320; 283/32, 37, 56

[56] References Cited

U.S. PATENT DOCUMENTS

| | | | |
|---|---|---|---|
| 1,403,772 | 1/1922 | Hannah | 40/584 |
| 2,280,682 | 4/1942 | Baker | 40/598 |
| 2,881,543 | 4/1959 | De Rowen | 40/598 |
| 3,487,573 | 1/1970 | Slovacek | 40/124.1 |
| 3,903,629 | 9/1975 | Gruna | 40/591 |

*Primary Examiner*—John F. Pitrelli

*Attorney, Agent, or Firm*—Bell, Seltzer, Park & Gibson

[57] ABSTRACT

A directional sign for providing observers with directional information to a particular location or event and including a rectangular signboard with indicia provided on one face of the signboard describing the particular location or event. Three directional indicators are provided on the face of the signboard closely adjacent three of the four edges of the signboard and oriented respectively upwardly, to the left, and to the right relative to the indicia. Means is provided to facilitate removing from view two of the three directional indicators when installing the directional sign for use so that only one directional indicator remains visible on the face of the installed sign and this indicator serves for signifying to observers of the sign the one correct direction which should be followed to the particular location or event.

6 Claims, 8 Drawing Figures

DIRECTIONAL SIGN

This invention relates to directional signs, and in particular to a directional sign for providing observers with directional information to a particular location or event.

Occasions frequently arise when an individual has need for a sign for furnishing directions to a particular location or event. Numerous examples could be cited. For example, a homeowner who wishes to sell his house needs signs for directing prospective customers from a busy thoroughfare to the location of his house in a residential area. Garage sales or similar sales are frequently conducted by homeowners, and directional signs are also needed for directing prospective customers to the location of such an event. Directional signs are also needed for marking the route of a marathon run or bicycle race.

Relatively inexpensive signs formed of cardboard or sheet metal have long been available at hardware stores and similar places and carry such information as HOUSE FOR SALE, FOR RENT, etc. This type of readily available signs however does not generally furnish directional information, and consequently it is a common practice for a homeowner or individual to prepare and post his own homemade sign carrying the directional information he wishes to convey. Such signs are frequently difficult to read and obviously carry less of an impact than a printed sign.

With the foregoing in mind, it is an important object of the present invention to satisfy the need for a relatively inexpensive directional sign which may be used by homeowners and individuals for conveying directional information to a variety of locations or events.

More particularly, it is an object of the present invention to provide a unique type of directional sign which may be inexpensively manufactured and which is capable of directing the observer in any desired direction to a designated location or event.

These and other objects are achieved in accordance with the present invention with a directional sign which has printed information provided on the face thereof describing the particular location or event, and which has three directional indicators provided on the face of the sign and oriented in three different directions, namely upwardly, to the left, and to the right. Means is provided to facilitate removing from view two of the three directional indicators when installing the directional sign for use so that only one directional indicator remains visible on the face of the installed sign and this indicator serves for signifying to observers of the sign the one correct direction which should be followed to the particular location or event.

More particularly, the present invention provides a directional sign for providing observers with directional information to a particular location or event, and wherein the sign comprises a rectangular signboard with indicia provided on one face of the signboard describing the particular location or event. Three directional indicators are provided on the same face of the signboard closely adjacent three of the four edges of the signboard. These three directional indicators are oriented respectively upwardly, to the left, and to the right relative to the indicia for indicating three directions which could be followed to the particular location or event. Perforations or score lines extend across the signboard respectively between the indicia and the three directional indicators to facilitate removing from view two of the three directional indicators when installing the directional sign for use. Thus, only one of the three directional indicators remains visible on the face of the signboard when the sign is installed for use, and this directional indicator serves for indicating to observers of the sign the one correct direction which should be followed to the particular location or event.

The directional indicators may take the form of elongate pointers or arrows extending alongside and parallel to the proximal edge of the signboard, or in an alternate arrangement the directional indicators may comprise a plurality of relatively short pointers or arrows oriented perpendicular to the proximal edge of the signboard.

Some of the objects and features of the invention having been described, others will become apparent as the description proceeds when taken in connection with the accompanying drawings, in which—

Figure 1:
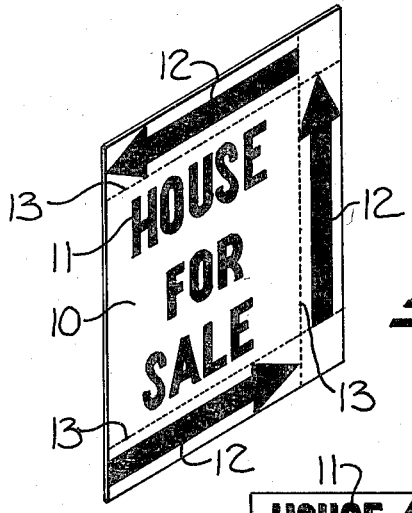
FIG. 1 is a front perspective view of a first form of the sign as it would appear prior to installation for use.

Referring now more particularly to the drawings, the directional sign of the present invention includes a generally rectangular signboard 10 formed of a flat sheet material such as paperboard, sheet metal, or plastic. As illustrated in FIG. 1, the rectangular signboard has a height dimension greater than its width dimension and has indicia 11 imprinted on the face of the signboard describing a particular location or event.

The following listing is exemplary of the kind of information which may be provided on the face of the sign: YARD SALE, GARAGE SALE, OPEN HOUSE, FLEA MARKET, CAR WASH, HORSE SHOW, PARKING, EXIT, AUCTION, ESTATE SALE, MARATHON, HOUSE FOR SALE, BOAT SHOW. In addition, in some instances it may be desirable to provide signs with a blank face to be filled in by the purchaser, or with printed information together with blank areas for receiving additional information to be filled in by the purchaser, such as times, dates, telephone numbers, etc.

The sign additionally includes three directional indicators 12 imprinted on the face of the sign and located closely adjacent three of the four edges of the signboard. The three directional indicators 12 are oriented in three different directions, namely to the left, to the right, and upwardly with reference to the printed indicia 11. These three directions represent three possible directions which could be followed to the particular location or event identified by the indicia 11. The directional indicator pointing upwardly is generally understood to signify that the indicated direction is straight ahead, while directional indicators pointing to the left and right obviously convey that the indicated direction is either to the left or to the right.

Also provided on the signboard 10 are three lines 13 extending across the face of the signboard adjacent the three edges of the signboard where the directional indicators 12 are located. More particularly, the lines 13 extend between the indicia 11 which is centrally located on the signboard and the three directional indicators 12 which are located adjacent three of the four sides of the signboard. The lines 13 preferably comprise either score lines or perforation lines.

Figure 2:
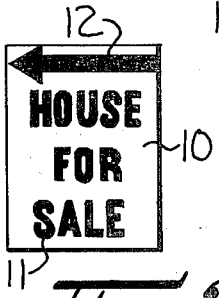
FIGS. 2 through 4 are three views of the same sign as it could appear when installed for use.
Figure 3:
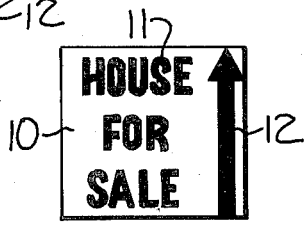
Figure 4:
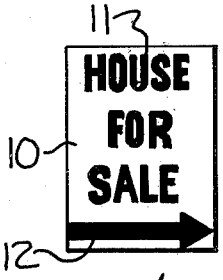
Figure 5:
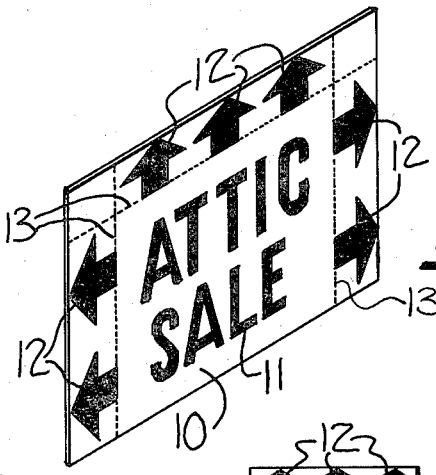
FIG. 5 is a front perspective view of a second form of the sign as it would appear prior to installation for use.

When the sign is installed for use, the user will select an appropriate location for the sign, usually at an intersection, for example. He will then select the appropriate directional indicator 12 which will convey to the observer the proper direction to be followed to the event or location represented by the indicia 11. Two of the three directional indicators 12 will then be removed from view so that only the one desired directional indicator remains visible on the face of the sign. The unwanted directional indicators may be removed from view by folding, cutting or tearing along the lines 13. Score lines are most suitable as a guide to facilitate folding, while perforation lines are most suitable to facilitate cutting or tearing to remove the unwanted directional indicators from view. Upon removal of the unwanted directional indicators from view, the sign will assume the configuration indicated by either FIGS. 2, 3 or 4. The sign may then be secured to a suitable support, such as a telephone pole for example, by an appropriate fastener such as a nail or staple.

The second form of the invention illustrated in FIGS. 5 to 8 is quite similar to that previously described, and to avoid repetitive description, elements which correspond to those previously described will bear the same reference characters wherever applicable.

The form of the invention illustrated in FIGS. 5 to 8 differs over that previously described in that the rectangular signboard is in a horizontal rather than a vertical orientation and has a width dimension greater than its height dimension. This orientation is more desirable in some instances since it permits the printed indicia 11 to use either longer words or larger characters depending upon the information to be conveyed.

Figure 6:
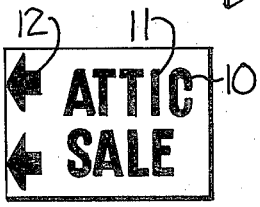
FIGS. 6 through 8 are three views of the same sign as it could appear when installed for use.
Figure 7:
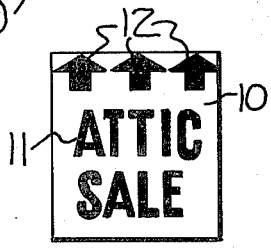
Figure 8:
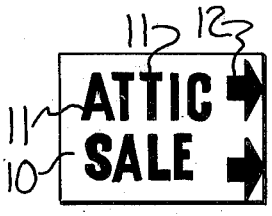

Additionally, it will be noted that each of the three differently oriented directional indicators comprise a plurality of relatively short pointers or arrows 12 rather than a single elongate arrow, and the pointers are oriented perpendicular to the proximal edge of the signboard rather than extending alongside and parallel thereto. As in the previous embodiment, the three differently oriented directional indicators point upwardly, to the left and to the right to represent that the direction which should be followed to the indicated location or event is either straight ahead, to the left or to the right. FIGS. 6 to 8 illustrate the three configurations which the sign may assume when installed for use.

In the drawings and specification, there have been set forth preferred embodiments of the invention, and although specific terms are employed, they are used in a generic and descriptive sense only and not for purposes of limitation.

That which is claimed is:

1. A directional sign for providing observers with directional information to a particular location or event, said sign comprising a rectangular signboard; indicia provided on one face of the signboard describing the particular location or event; three directional indicators provided on said one face of the signboard closely adjacent three of the four edges of the signboard and oriented respectively upwardly, to the left, and to the right relative to said indicia for indicating three directions which could be followed to the particular location or event; and three respective lines extending across said one face of the signboard respectively between said indicia and said three directional indicators to facilitate removing from view two of the three directional indicators when installing the directional sign for use so that only one directional indicator remains visible on the face of the signboard when the sign is installed and serves for indicating to observers of the sign the one correct direction which should be followed to the particular location or event.

2. A directional sign for providing observers with directional information to a particular location or event, said sign comprising a rectangular signboard formed of generally flat sheet material; indicia imprinted on one face of said signboard in a central location and describing the particular location or event, three directional indicators imprinted on said one face of said signboard closely adjacent three of the four edges of the signboard and oriented respectively upwardly, to the left, and to the right relative to said indicia for indicating three directions which could be followed to the particular location or event; and three respective lines extending across said one face of said signboard adjacent and parallel to said three edges of the signboard, said lines extending respectively between said indicia and said three directional indicators to facilitate removing from view two of the three directional indicators when installing the signboard for use so that only one directional indicator remains visible on the face of the signboard when the sign is installed and serves for indicating to observers of the sign the one correct direction which should be followed to the particular location or event.

3. A directional sign according to claim 1 or 2 wherein each of said three directional indicators comprises an elongate pointer extending alongside and parallel to the proximal edge of the signboard.

4. A directional sign according to claim 1 or 2 wherein each of said three directional indicators comprises a plurality of relatively short pointers oriented perpendicular to the proximal edge of the signboard.

5. A directional sign according to claim 1 or 2 wherein each of said three lines comprises a score line adapted to facilitate folding the unwanted directional indicators behind the signboard to remove them from view.

6. A directional sign according to claim 1 or 2 wherein each of said three lines comprises a perforation line adapted to facilitate physically removing the unwanted directional indicators from the signboard to remove them from view.

* * * * *